US010307645B2

(12) United States Patent
Zucchelli et al.

(10) Patent No.: US 10,307,645 B2
(45) Date of Patent: Jun. 4, 2019

(54) HEAD AND NECK FLOATING SUPPORT DEVICE

(76) Inventors: Joanne Drew Zucchelli, Stockton, CA (US); Debra Ehrlich May, Stockton, CA (US)

( * ) Notice: Subject to any disclaimer, the term of this patent is extended or adjusted under 35 U.S.C. 154(b) by 432 days.

(21) Appl. No.: 13/270,620

(22) Filed: Oct. 11, 2011

(65) Prior Publication Data

US 2012/0100768 A1 Apr. 26, 2012

Related U.S. Application Data

(60) Provisional application No. 61/405,553, filed on Oct. 21, 2010.

(51) Int. Cl.

| | |
|---|---|
| ***B63C 9/13*** | (2006.01) |
| ***A63B 31/00*** | (2006.01) |
| *A47C 7/38* | (2006.01) |

(52) U.S. Cl.

CPC ..... *A63B 31/00* (2013.01); *A47C 7/383* (2013.01); *A63B 2208/03* (2013.01); *B63C 2009/133* (2013.01)

(58) Field of Classification Search

CPC ... B63C 9/155; B63C 9/115; B63C 2009/133; B63C 9/08; A47C 7/383; A47D 13/08; A47D 13/083

USPC ..... 441/123; 5/636, 637

See application file for complete search history.

(56) References Cited

U.S. PATENT DOCUMENTS

| | | | | |
|---|---|---|---|---|
| 2,805,420 | A * | 9/1957 | Spellos | 2/24 |
| 3,724,012 | A | 4/1973 | Sanderson | |
| 3,727,249 | A | 4/1973 | Bonthelius | |
| 3,903,555 | A | 9/1975 | Busby | |
| 4,472,151 | A | 9/1984 | Hoffman | |
| 4,800,871 | A | 1/1989 | Florjancic | |
| 4,871,338 | A | 10/1989 | Hoffman | |
| 5,194,311 | A * | 3/1993 | Baymak et al. | 428/116 |
| 5,567,191 | A | 10/1996 | Gordon | |
| 5,690,525 | A | 11/1997 | Bing | |
| 5,746,633 | A | 5/1998 | Jeffrey | |
| 5,775,967 | A | 7/1998 | Lacoursiere | |
| 5,928,046 | A * | 7/1999 | Constan-Tatos | 441/118 |
| 6,042,440 | A * | 3/2000 | Ettl | 441/88 |
| 6,089,936 | A | 7/2000 | Hoffman | |
| 6,537,119 | B2 * | 3/2003 | Deslauriers | 441/106 |
| 6,638,126 | B2 | 10/2003 | Lariviere | |
| 6,761,604 | B1 | 7/2004 | Hronek | |
| 6,776,678 | B2 | 8/2004 | Courtney | |
| 6,851,143 | B2 * | 2/2005 | Matthews Brown | 5/490 |
| 6,857,136 | B1 | 2/2005 | Bradley | |

(Continued)

OTHER PUBLICATIONS

JustSew, How to Make Foam Pillow, snapshot Jan. 25, 2009, http://www.ehow.com/how_4423510_make-foam-pillow.html, retrieved Sep. 5, 2014.*

*Primary Examiner* — Andrew Polay

(74) *Attorney, Agent, or Firm* — Maier & Maier, PLLC

(57) ABSTRACT

A water floating device that offers support for the head or neck of a user when swimming or practicing water exercises. The floating support device includes a unitary piece body made of a floating and waterproof material. The unitary piece body has a U-shape including a curved central section having a first leg on a first end and a second leg on a second end. The first leg and the second leg project from the curved central section. The first leg and the second leg angle inwardly to one another.

8 Claims, 2 Drawing Sheets

(56) References Cited

U.S. PATENT DOCUMENTS

| | | | | |
|---|---|---|---|---|
| 6,887,186 | B2 | 5/2005 | Bambanian | |
| 7,146,665 | B1 * | 12/2006 | Moorin | 5/644 |
| 7,465,207 | B2 | 12/2008 | Whitney | |
| 7,641,529 | B2 | 1/2010 | Deville | |
| 7,798,879 | B2 | 9/2010 | James | |
| 2001/0024916 | A1 * | 9/2001 | Cynamon | 441/80 |
| 2002/0094735 | A1 * | 7/2002 | Lariviere | 441/123 |
| 2004/0005827 | A1 | 3/2004 | Garofalo | |
| 2006/0217014 | A1 | 9/2006 | Pierce | |
| 2007/0072499 | A1 | 3/2007 | Hennings | |
| 2008/0104914 | A1 * | 5/2008 | Lemieux | 52/403.1 |

* cited by examiner

HEAD AND NECK FLOATING SUPPORT DEVICE

CROSS-REFERENCE TO RELATED APPLICATIONS

This application claims the benefit of priority to U.S. Provisional Application No. 61/405,553 filed Oct. 21, 2010, the contents of which are incorporated herein by reference.

BACKGROUND OF THE INVENTION

The present invention generally relates to a water floating support device. More particularly, the present invention relates to a water floating device designed to support the user's head or neck for recreational or exercise purposes.

In recent years, water exercises have increased in popularity because the buoyancy of water takes the weight off the spine and legs while still allowing vigorous exercise. A variety of flotation devices are known in the art to allow a person to float while relaxing or practicing water exercises. Unfortunately, current flotation devices do not provide support for the swimmer's head or neck when swimming or practicing water exercises.

As can be seen, there is a need for a water floating device that provides support for the swimmer's head or neck when swimming or practicing water exercises.

SUMMARY OF THE INVENTION

In one aspect of the present invention, a floating support device includes a unitary piece body made of a floating and waterproof material; the unitary piece body has a U-shape including a curved central section having a first leg on a first end and a second leg on a second end; the first leg and the second leg project from the curved central section; and the first leg and the second leg angle inwardly to one another.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a water floating device that offers support for the head or neck of a user when swimming or practicing water exercises.

Figure 1:
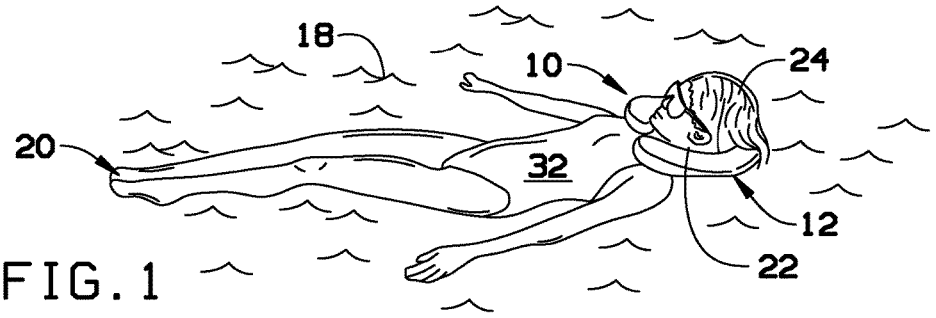
FIG. 1 illustrates a perspective front view of a floating support device according to an exemplary embodiment of the present invention showing the floating support device in use.
Figure 2:
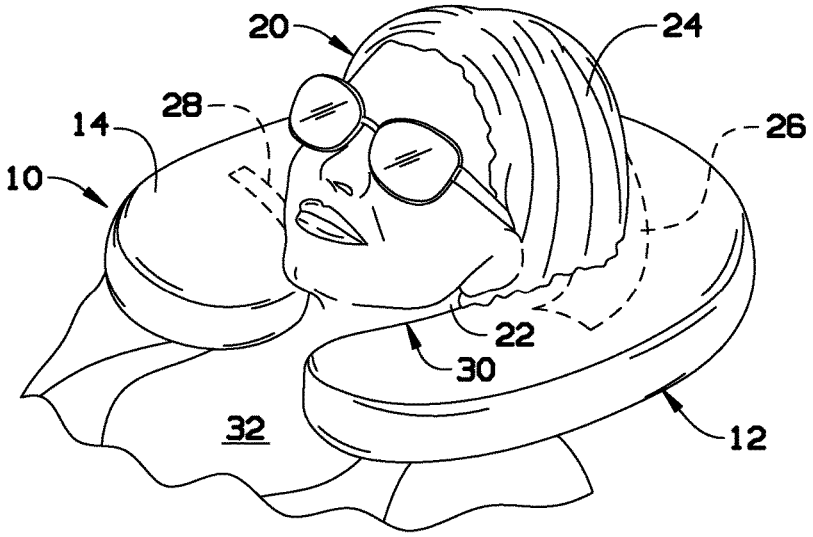
FIG. 2 illustrates a detailed view of the floating support device of FIG. 1 showing the floating support device placed around the neck of a user.
Figure 3:
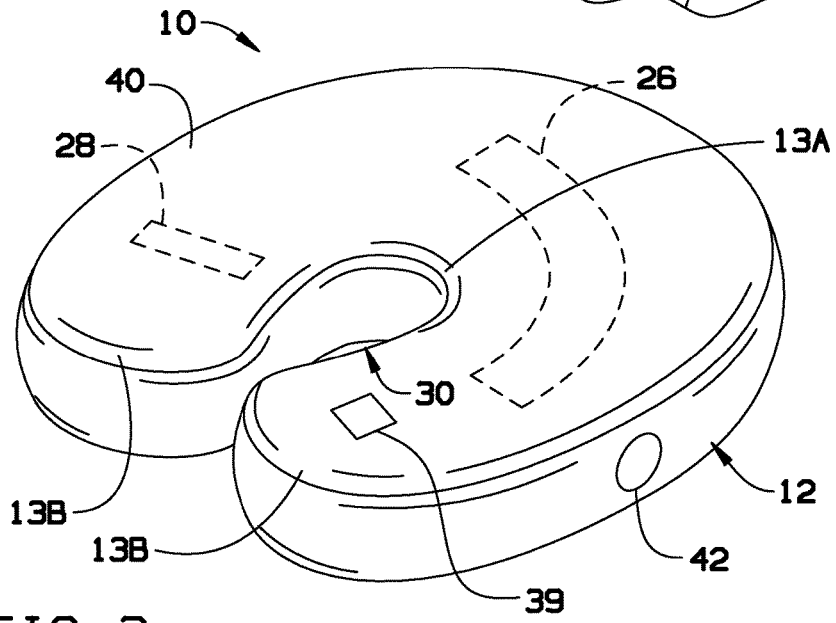
FIG. 3 illustrates a perspective front view of the floating support device of FIG. 1.
Figure 4:
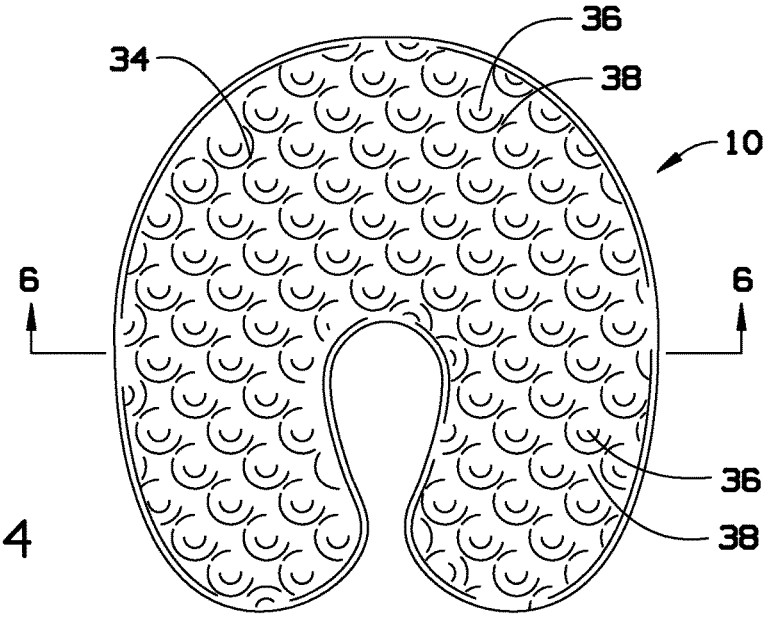
FIG. 4 illustrates a bottom view of the floating support device of FIG. 1.
Figure 5:
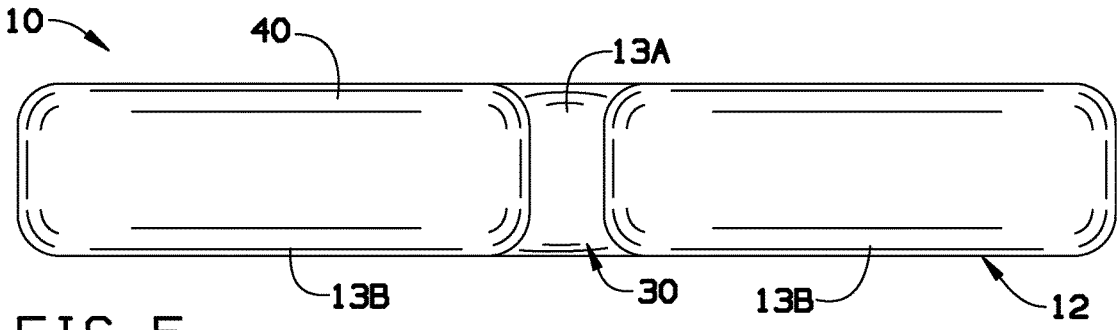
FIG. 5 illustrates a front view of the floating support device of FIG. 1.
Figure 6:
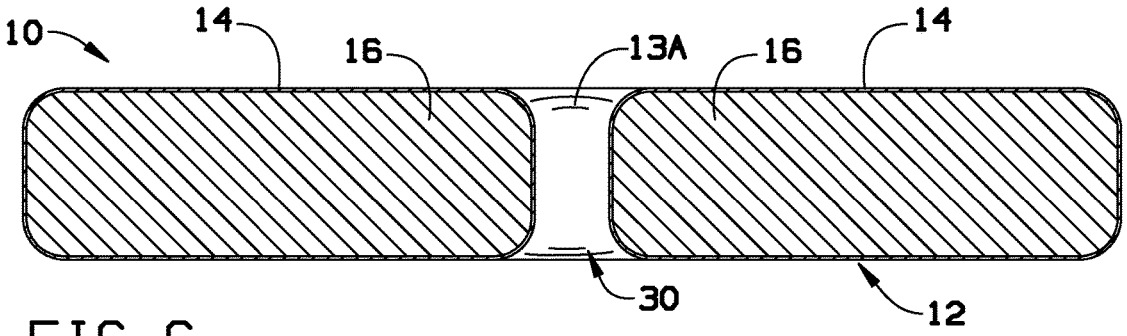
FIG. 6 illustrates a cross-section view of the floating support device taken along line 6-6 in FIG. 5.

FIGS. 1-6 show a floating support device 10 according to an exemplary embodiment of the present invention. The floating support device 10 may be used to support a head 24 and neck 22 of a user 20 while swimming or exercising in the water 18.

The floating support device 10 may include a unitary piece body 12. The unitary piece body 12 may be made of a floating and waterproof material 16 that may float on water. The unitary piece body may be made of, for example, rubber, plastic, encapsulated expanded polystyrene, foam, polyethylene foam, closed cell foam, recycled foam, vinyl covered foam, polymer, resin, or composite material. In some embodiments, the unitary piece body 12 may be made of foam, rubber, or polyethylene foam. The size of the unitary piece body 12 may depend on the size of the neck 22 and the head 24 of the user 20. The floating support device 10 may come in different sizes, for example, X-small, small, medium, large, x-large, xx-large, or xxx-large.

The unitary piece body 12 may be a solid body or a hollow body. When using a hollow body, the unitary piece body may be filled with a viscoelastic gel or fluid. The fluid may be, for example, air, oxygen, or $CO_2$.

The unitary piece body 12 may have a shape that may cradle the neck 22 and support the head 24 of the user 20. The unitary piece body 12 may have, for example, a U-shape. The U-shape may include a curved central section 13*a* having a pair of legs 13*b* projecting from the curved central section 13*a*. The pair of legs 13*b* may angle inwardly to one another. The outside contour of the curved central section 13*a* may have different shapes. The different shapes may be, for example, a geometrical shape, heart shape, flower shape, animal shape, fish shape, dolphin shape, or holiday motives. The user 20 may spread apart the legs 13*b* in order to introduce the neck 22 on a hole 30 formed between the legs 13*b*. The configuration of the unitary piece body 12 may be designed to inherently grip and support the neck 22 of the user 20.

A coating layer 14 may be applied to the unitary piece body 12. The coating layer 14 may help protect the unitary piece body 12. The coating layer may include a waterproof material. The waterproof material may be, for example, poly-vinyl.

A cover 40 may be placed over the unitary piece body 12. The cover 40 may be made of a waterproof soft material. The waterproof soft material may be, for example, fabric, cloth, terry cloth, neoprene, nylon, plastic, or vinyl. The cover 40 may include a space (not shown) to insert a small cushion, pillow, or extra piece of foam.

A pocket 39 may be added to the cover 40. The pocket 39 may allow the user 20 to store small objects, for example, keys, money, or credit cards.

Advertising materials 26 may be placed around the surfaces of the unitary piece body 12 or over the cover 40. The advertising materials may be, for example, logos, slogans, holiday motives, or art.

An instruction label 28 may be placed around the surfaces of the unitary piece body 12 or over the cover 40. The instruction label 28 may include, for example, warning information or instructions on how to use the floating support device 10.

The bottom face 34 of the unitary piece body 12 may include a textured surface 36, 38. The texture surface may include, for example, peaks and valleys. The textured surface may allow the user to securely grip the unitary piece body 12 when using the hands or head on the unitary piece body 12. In addition, the textured surface may aid in preventing slipping off the unitary piece body 12. The textured surface may be more aesthetically pleasing than a plain solid surface.

A connection device 42 may be placed on the unitary piece body 12 or the cover 40. The connection device 42 may be, for example, a loop or ring. The connection device 42 may allow the user 20 to attach a leash, rope, or handle to tow or carry the floating support device 10.

A flashlight (not shown), lights (not shown), or fluorescent strips (not shown) may be attached to the unitary piece body 12 or the cover 40.

Handles (not shown) may be attached to the floating support device 10.

In some embodiments, the floating support device 10 may be constructed by joining two pieces of foam.

The user 20 may place the floating support device 10 around his/her neck 22 such that the legs 13*b* of the unitary piece body 12 may surround the neck 20 and the curved central section 13*a* may support the head 24 of the user 20. Then, the user 20 may place his/her torso 32 above the surface of the water 18.

In addition, the user 20 may place the floating support device 10 around his/her neck 22 with the legs 13*b* extending towards the back of the neck 22, resting his/her chin on the curved central section 13*a*.

Furthermore, the user 20 may use the floating support device 10 as a chair, a cushion, a kickboard, or a head cushion.

The floating support device may include a leg or arm support (not shown). The user 20 may place his/her leg, ankle, arm, or hand inside the leg or arm support (not shown).

When use as a cushion, the user 20 may be sitting on the floating support device 10 in the water with or without holding on with hands. Out of the water, the user 20 may place the floating support device 10 directly on a chair seat or side of pool or on the ground.

The floating support device 10 may be used as a kneeling pad or as a back support cushion out of the water, on a chair, against a wall, or inside the car.

The floating support device 10 may provide the user 20 with a comfortable water experience, including water fitness, recreation, and relaxation by supporting a person's neck and head.

The floating support device 10 may be used in the field of Aquatic Physical Therapy and Rehabilitation.

It should be understood, of course, that the foregoing relates to exemplary embodiments of the invention and that modifications may be made without departing from the spirit and scope of the invention as set forth in the following claims.

What is claimed is:

1. A floating support device comprising:

a unitary piece body having a solid core and made of a floating and waterproof material;

wherein the unitary piece body has a U-shape including a curved central section having a first leg on a first end and a second leg on a second end, and a hole formed between the first leg and the second leg and configured to receive the neck of the user;

wherein the first leg and the second leg project from the curved central section;

wherein the first leg and the second leg angle inwardly to one another forming an acute angle, the angle of the first and second legs being operable to grip the neck of the user within the hole formed between the first leg and the second leg, and wherein the unitary piece body has a flat top face and a flat bottom face, the flat top face being smooth and the flat bottom face being textured, the texture having semi-spherical peaks and valleys, and at least one wall disposed vertically between the flat top face and flat bottom face forming a substantially rectangular cross section, wherein the curved central section is operable to surround the neck of a user such that a head of the user rests on the smooth flat top face a distance above a surface of the water.

2. The floating support device according to claim 1, wherein the unitary piece body is made of rubber, plastic, foam, polyethylene foam, closed cell foam, recycled foam, vinyl covered foam, polymer, resin, or composite material.

3. The floating support device according to claim 1, further comprising a coating layer applied to the unitary piece body.

4. The floating support device according to claim 1, further comprising a cover placed over the unitary piece body.

5. The floating support device according to claim 4, further comprising a pocket secured to the cover.

6. The floating support device according to claim 1, further comprising a connection device attached to the unitary piece body.

7. The floating support device according to claim 3, wherein the coating layer is poly vinyl.

8. The floating support device according to claim 3, wherein curved central section includes an inner section and an outer section, wherein the outer section has a shape selected from geometrical shape, heart shape, flower shape, animal shape, fish shape, dolphin shape, or holiday motifs.

* * * * *